United States Patent [19]

Kirby, Jr.

[11] Patent Number: 4,878,642

[45] Date of Patent: Nov. 7, 1989

[54] OBJECT SUPPORT FOR ATTACHMENT TO A CYLINDRICALLY SHAPED SUPPORT MEMBER

[76] Inventor: Emery L. Kirby, Jr., 4052 Antiem St., San Diego, Calif. 92111

[21] Appl. No.: 872,858

[22] Filed: Jun. 11, 1986

[51] Int. Cl.[4] ..... A47K 1/08

[52] U.S. Cl. ..... 248/311.2; 248/231.7

[58] Field of Search ..... 248/311.2, 310, 314, 248/315, 316, 230, 236.7, 210, 238; 403/97, 385

[56] References Cited

U.S. PATENT DOCUMENTS

| | | | |
|---|---|---|---|
| 1,232,871 | 7/1917 | Watters | 403/97 |
| 1,954,269 | 4/1934 | Slowing | 248/311.2 X |
| 2,912,205 | 11/1959 | Toune | 248/311.2 X |
| 3,370,820 | 2/1968 | Liss et al. | 248/320 X |
| 3,495,857 | 2/1970 | Hawke et al. | 403/97 X |
| 3,762,591 | 10/1973 | Gray | 248/346.1 |
| 3,840,204 | 10/1974 | Thomas et al. | 248/311.2 |
| 3,881,677 | 5/1975 | Ihlenfled | 248/311.2 |
| 4,535,921 | 8/1985 | Sanders | 248/311.2 X |

*Primary Examiner*—Ramon O. Ramirez
*Attorney, Agent, or Firm*—Frank D. Gilliam

[57] ABSTRACT

One embodiment of the invention provides a beverage container holder that can be removably secured to a cylindrical support member. This embodiment comprises an open circular container attached to a clamp member. The clamp member has an open inner cylindrical bore surface opposite to its open circular container attachment. The open bore surface is forcible over a cylindrical support member of slightly larger diameter for support thereby. The open circular container is positionable by selective rotation of the open circular container relative to the clamp member and selective rotation of the clamp member relative to the cylindrical support member. In the second embodiment the open circular container is bottomless to enable a fishing pole or the like to pass through the open container. Spring or locking members may be positioned between the open circular container and clamp member connection to maintain the open circular holder in a selected position relative to the support member.

8 Claims, 1 Drawing Sheet

OBJECT SUPPORT FOR ATTACHMENT TO A CYLINDRICALLY SHAPED SUPPORT MEMBER

BACKGROUND OF THE INVENTION

The invention is directed to object holders and more particularly to a beverage container holder and a fishing pole holder which can be removably attached to a cylindrical support member and may be positioned vertical, horizontal, or at any angle therebetween and still support the object held thereby in at a selected angle relative to the cylindrical support member.

There are many prior art container holders that can be attached to a cylindrical support member.

W. A. Foster, Jr., teaches in U.S. Pat. No. 3,463,436 a coaster that can be attached to vertical cylindrical support member by chain means.

William Blair Shook in U.S. Pat. No. 4,009,810 teaches a water bottle cage for a bicycle cylindrical frame member. The angular position of the water cage and beverage container carried thereby are determined by the angle of the frame support member to which it is attached.

Van C. Wagnor in U.S. Pat. No. 4,071,175 teaches an anti-rattle bicycle beverage container holder that must necessarily be attached to a horizontal cylindrical support member for it's intended use.

Linda D. Harris in U.S. Pat. No. 4,256,281 teaches a cup holding apparatus that may be clamped only to a horizontal cylindrical support member.

In general the prior art holders that are designed for securing in various manners to cylindrical members are intended for attachment to either substantially vertically or horizontally positioned cylindrical members, especially if the object to be supported is an open liquid container or the like.

The water bottle container of U.S. Pat. No. 4,009,810 could not be supported in the manner taught if the container were open. If the container supported thereby was open then it likewise would be attached to a substantially vertically positioned cylindrical support member.

There has not been a satisfactory object holder which can be attached to a cylindrical support member regardless of its angular position and adjustable to support an object at any selected angle until the emergence of the present invention.

SUMMARY OF THE INVENTION

One embodiment of this invention is directed to an open circular container having a bottom surface for support of an open container of a liquid beverage and in a second embodiment for the support of fishing poles or the like.

The object holder comprises a clamp member with an open cylindrical bore surface having a cross-section greater than a semi-circle which can be forced over a cylindrical support member of a slightly larger diameter than the diameter of the bore of the clamp member for securing the clamp member thereto by the gripping resiliency of the clamp member. The clamp member can be positioned at any location around the circumferance of the cylindrical support member. The surface of the clamp member opposite the open bore side is provided with an attachment protrusion extending perpendicular to the bore through the clamp member. A open circular container is provided which has an outer surface attachment protrusion extending perpendicular to its opening center line. The distal end face of the clamp and open circular container protrusions are connected so as to provide selective relative rotation therebetween. In one embodiment, the open circular container includes a bottom surface with a plurality of apertures therethrough for providing a liquid spill drain and a side wall with a plurality of slots open at their upper surface for receiving a liquid container handle there through. In another embodiment, the open circular container is bottomless and has no side wall slots.

In use the support clamp is forced apart at its open surface to fit over a cylindrical support member of slightly larger diameter and when clamped thereover the clamp is rotatable relative to the cylindrical support member for desired location positioning and the open circular container is rotatable relative to the clamp member until the open circular container is positioned in a desired position. When in this desired position the connection between the clamp member and cylindrical support member and the clamp member and the open circular container secure the open circular container in that position.

The clamp member is secured to the cylindrical support member by means of the resiliency of the construction material of the clamp and the relative size of the bore of the clamp and the diameter of the cylindrical support member. Considerable force is required for rotation therebetween. A bolt, nut, and lock washer combination with the bolt extending centrally through the connected protrusions acting as an axle therebetween allows relative rotation when the nut is loosened and prevents relative rotation therebetween when the nut is tightened on the bolt causing the lock washer positioned between the protrusion distal end faces to dig into the adjacent surface.

In this manner of adjustment, the object holder can be adjusted to support an open container of liquid horizontally or support a fishing pole at a selected angle of inclination regardless of the angle of the cylindrical support member.

An object of this invention is to provide an object support that can be positioned at a selective angle regardless of the angle of the cylindrical support member to which it is attached.

Another object of this invention is to provide an object support that can be angularly adjusted readily and easily secured in a selected angular position.

Still another object of this invention is to provide a support for an open beverage container filled with a liquid which can be attached to a cylindrical support member regardless of the angle of inclination of that support.

Yet another object of this invention is to provide a fishing pole support for holding a fishing pole at a selected angle of inclination regardless of the angle of inclination of the cylindrical support member to which it is attached.

Additional advantages and features of the present invention will become apparent from the following description of the preferred embodiments taken in conjunction with the accompanying drawing and the claims appended hereto.

DESCRIPTION OF THE PREFERRED EMBODIMENTS

Figure 1:
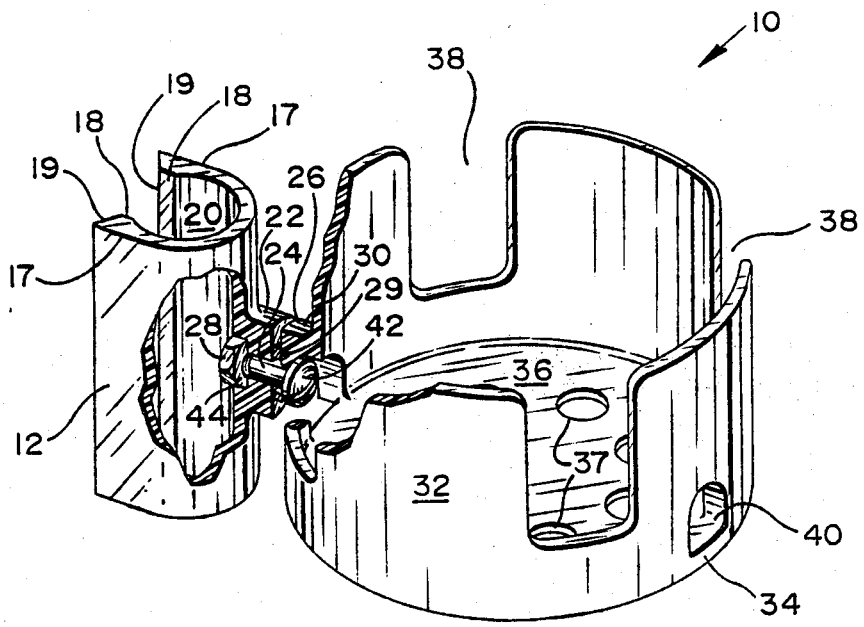
FIG. 1 is a perspective view in partial cut away of the present invention shown in an installed relationship to a cylindrical support member and FIG. 2 is a perspective view of a second embodiment of the present invention.

Referring now to the drawing figures in particular to FIG. 1, there is illustrated therein an object support 10 in accordance with one embodiment of the present invention. The support 10 includes a clamp member 12 generally "C" shaped in cross section adapted to clamp on and grasp a cylindrical support member 14 (see FIG. 2). The distal end surfaces 17 of the clamp member 12 include opposing shoulders 18. The distal surfaces 19 of the opposing shoulders 18 are angled away from each other and from the longitudinal center line of the bore through the tubular member 12. The inner surface 20 of the clamp member includes an area greater than a semicircle. Extending from the side wall of the tubular member substantially opposite the opening therein is an attachment member 22.

By means of a bolt 24, lock washer 26 and nut 28, the distal end 21 of attachment member 22 is attached to the distal end 29 of a similar attachment member 30. The opposite end of attachment member 30 is fixedly attached to the side wall 32 of an open circular container 34. The open circular container 34 includes a bottom surface 36. A plurality of drain apertures 37 are spacedly located about the bottom surface. The side wall 32 of the open circular member includes a plurality of spaced apart slots 38 open along their upper surface. The slots are provided so that if a liquid container, not shown, includes a supporting handle such as, a handle on a conventional coffee cup, that handle can extend through a selected one of the open slots 38. An elongated aperture 40 extends through side wall 32. Aperture 40 is located substantially opposite the slotted end 42 of the bolt 24. This allows the bolt 24 to be rotated either clockwise or counter-clockwise by a screw driver passing through aperture 40 relative to the nut 28 which is captured by a nut configured recess 44 through wall 20 within attachment member 22. A lock washer 26 is located between the faces of the distal end surfaces of attachment member 22 and 30. This washer may be a lock washer of any configuration such as, but not limited to, a star washer, split ring washer, Belville, or the like.

Figure 2:
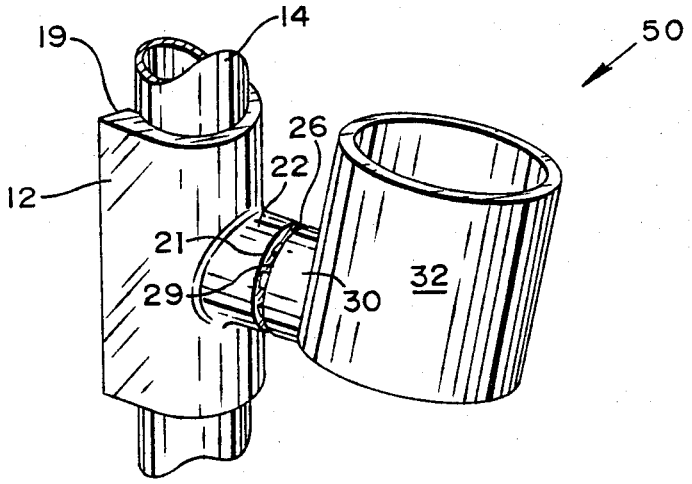

Referring now particularly to FIG. 2, there is illustrated therein an object support 50 in accordance with a second embodiment of the present invention. Like object holder 10, object holder 50 includes the same features thereof except there is no bottom surface 36 or side slots 38. Generally the diameter of open circular container 34 of the FIG. 1 showing is larger than the equivalent element of the FIG. 2 showing; however, this may not always be the case.

It should be understood that the open circular container 34 of the FIG. 1 showing is generally sized to hold a separate beverage container such as, but not limited to, a can, drinking glass, cup, or the like while the open bottom embodiment of container 32 is sized to receive and support a plurality of different diameter fishing poles. The beverage containers contemplated to be supported are of a generally larger diameter than the fishing poles.

In use, the angled surfaces 19 of the clamp member are forced over a cylindrical support member 14 of slightly larger diameter than the bore through the clamp member 12. The resiliency of the material of construction of the clamp member is chosen to be slightly resilient with a memory such as, for example, ABS, PVC, plastic or the like. When positioned over the cylindrical support member the resiliency of the clamp member causes the inner surface thereof to grasp the outer surface of the cylindrical support member. The grasping force is sufficient to prevent unwanted or casual rotation of the clamp member about the cylindrical support member by the weight of the object to be supported thereby, but not so tight as to prevent manual forced relative rotation for positioning as hereinafter discussed in more detail.

The bolt/nut combination is loosened to allow ease of manual relative rotation between the clamp member and the open circular container. The open circular container is then rotated relative to the clamp member to a selected position, a screw driver is then inserted through the elongated aperture 40 in the container wall engaging the bolt and the bolt is then rotated relative to the captived nut until the protrusion faces are forced against the lock washer with sufficient force to slightly dig into the surface to prevent relative rotation between the faces. A beverage in a container or a fishing pole can now be inserted into the open circular container of FIGS. 1 and 2 respectfully.

It should be appreciated that the cylindrical support member can have any angle of inclination relative to the selected use inclination or position of the open circular container. Generally the bottom surface of the open circular container of the FIG. 1 embodiment will be substantially horizontal while the side wall of the open circular container of the FIG. 2 embodiment will be slightly angled from true vertical.

It should be understood that container 32 could take many different configurations such as, for example, a flat tray for serving food, a closed container for valuables, holder for sewing items, etc.

While it will be apparent that the preferred embodiments of the invention disclosed are well calculated to provide the advantages and features above stated, it will be appreciated that the invention is susceptible to modification, variation, and change without departing from the proper scope of fair meaning of the claims hereafter.

What is claimed is:

1. An object holder removably attachable to a cylindrical support member comprising:

an upstanding container open at both ends;

a first attachment member carried by said upstanding container and extending substantially perpendicular thereto;

a resilient clamp member having a central bore and an open side wall;

a second attachment member carried by said resilient clamp member and extending substantially perpendicular thereto; and connecting means selectively length adjustable for locking said first and second attachment members when adjusted to one length and for selective relative rotation therebetween when adjusted to a longer length, wherein the open side of said resilient member can be forced over said cylindrical support member of a slightly larger diameter than said bore for attachment thereto and said first and second attachment surfaces are rotatably positionable relative to each other and lockable in any selected rotational position by adjusting the length of said connecting means.

2. The invention as claimed in claim 1 wherein said open container is circular.

3. The invention as defined in claim 1 additionally comprises a flat base member attached to one of said open ends of said upstanding open container for closing one of said open ends.

4. The invention as defined in claim 3 wherein a plurality of drain holes pass through said flat base member.

5. The invention in claim 3 wherein said upstanding container further comprises spaced apart open slots there through open to the upper surface of said container and extending to a closed end terminus positioned adjacent to said flat base member for accepting a beverage container having a protruding handle wherein said handle extends through a selected one of said open slots.

6. The invention as defined in claim 1 wherein said first and second attachment members include flat opposing surfaces and said connecting means include aligned bores through their longitudinal centers and said connecting means comprises a bolt passing through said bores and secured at each end thereof.

7. The invention as defined in claim 6 wherein said connecting means further includes a lock washer carried by said bolt positioned between said flat opposing surfaces for penetrating said flat opposing surfaces and thereby locking together said attachment members when said connecting means is adjusted to said one length.

8. The invention as defined in claim 1 wherein said resilient clamp member is substantially "C" shaped.

* * * * *